US007028764B2

(12) United States Patent
Reagen

(10) Patent No.: US 7,028,764 B2
(45) Date of Patent: Apr. 18, 2006

(54) REFRIGERATION EVAPORATOR

(75) Inventor: Scot Reagen, Lake Orion, MI (US)

(73) Assignee: TI Group Automotives Systems, LLC, Warren, MI (US)

( * ) Notice: Subject to any disclaimer, the term of this patent is extended or adjusted under 35 U.S.C. 154(b) by 256 days.

(21) Appl. No.: 10/376,389

(22) Filed: Feb. 28, 2003

(65) Prior Publication Data

US 2003/0196783 A1 Oct. 23, 2003

Related U.S. Application Data

(60) Provisional application No. 60/361,139, filed on Mar. 1, 2002.

(51) Int. Cl.
*F28D 1/00* (2006.01)

(52) U.S. Cl. ..... 165/150; 165/182; 165/144; 62/515

(58) Field of Classification Search ..... 165/150, 165/122, 182, 151, 144; 62/515
See application file for complete search history.

(56) References Cited

U.S. PATENT DOCUMENTS

| | | | | |
|---|---|---|---|---|
| 1,057,081 | A * | 3/1913 | Nelman | 237/17 |
| 1,149,065 | A * | 8/1915 | Keith | 165/122 |
| 1,901,090 | A * | 3/1933 | Eule et al. | 165/67 |
| 1,921,041 | A * | 8/1933 | Reynolds | 29/890.046 |
| 2,146,076 | A * | 2/1939 | Kogel | 62/485 |
| 3,433,300 | A * | 3/1969 | Pasternak | 165/151 |
| 3,724,537 | A * | 4/1973 | Johnson | 165/133 |
| 3,780,799 | A * | 12/1973 | Pasternak | 165/150 |
| 4,175,617 | A * | 11/1979 | Hahn et al. | 165/122 |
| 4,580,623 | A | 4/1986 | Smitte et al. | |
| 4,778,004 | A * | 10/1988 | Paulman et al. | 165/150 |
| 4,799,540 | A * | 1/1989 | Pietzcker | 165/76 |
| 5,183,105 | A | 2/1993 | Adams | |
| 5,228,198 | A | 7/1993 | Paulman et al. | |
| 5,402,656 | A * | 4/1995 | Jaster et al. | 62/515 |
| 5,507,340 | A * | 4/1996 | Alston | 165/150 |
| 5,540,276 | A | 7/1996 | Adams et al. | |
| 5,704,123 | A | 1/1998 | Paulman et al. | |
| 5,765,284 | A | 6/1998 | Ali et al. | |
| 6,209,628 | B1 | 4/2001 | Sugimoto et al. | |
| 6,253,839 | B1 | 7/2001 | Reagen et al. | |

FOREIGN PATENT DOCUMENTS

| | | |
|---|---|---|
| JP | 4-86491 | 3/1992 |
| JP | 6-79379 | 3/1994 |

* cited by examiner

*Primary Examiner*—Terrell Mckinnon
(74) *Attorney, Agent, or Firm*—Leydig, Voit & Mayer, Ltd.

(57) ABSTRACT

An evaporator for disposition along an air flow for cooling the air. The evaporator comprises a continuous serpentine tube having an inlet and an outlet and a plurality of inner fins attached to the serpentine tube. The serpentine tube including at least one column of tube runs. The tube runs are grouped into tube run sets. Each tube run set is defined by at least one reverse bend and the tube runs extending from the ends of the at least one reverse bend. The centerline of each tube run set is not parallel to the centerline of an adjacent tube run set. Each inner fin extends between at least two tube runs of a tube run set.

14 Claims, 9 Drawing Sheets

REFRIGERATION EVAPORATOR

This non-provisional application claims the benefit of U.S. Provisional Application No. 60/361,139. The present invention relates generally to an evaporator for use in a refrigeration system. More particularly, it relates to a fin type evaporator for use in household refrigerators and other refrigeration systems.

FIELD OF THE INVENTION

Government regulations and environmental concerns continue to reduce the amount of energy an appliance is allowed to consume. Improving the heat transfer properties of the evaporator reduces the energy consumption of a refrigeration system.

Several attempts have been made to increase the cooling efficiency of an evaporator by varying the arrangement of the tube pattern and fin shape. U.S. Pat. No. 4,580,623 discloses a heat exchanger having parallel rows of serpentine tube coils slanted in the same direction and using ultra thin fins having a pattern embossed thereon to induce turbulence in the air flow over the evaporator.

Another method of arranging the serpentine tube coils to increase the cooling efficiency of the evaporator is described in U.S. Pat. No. 5,183,105. This construction has a continuous tube with a plurality of reverse bends forming a plurality of parallel tube rows arranged in sets of two as determined by each of the respective reverse bends. The tubes in the tube bundle are arranged such that, when viewed in cross section, lines drawn between the centers of the sets of two tubes form a herringbone pattern.

While these methods increase the cooling efficiency of the evaporator by using the staggered arrangement of the tube bundle, further cooling efficiency can be obtained by a more efficient arrangement of the fins. Such an evaporator is taught by Reagen et al. in U.S. Pat. Nos. 6,253,839 and 6,370,775, assigned to the present assignee. The evaporator taught in U.S. Pat. Nos. 6,253,839 and 6,370,775 comprises a continuous serpentine tube having at least one column of parallel tube runs. Each tube run is defined by at least one reverse bend. The column of parallel tube runs has an overall length defined by the distance between the outermost tube runs. The evaporator further comprises a plurality of inner fins attached to the individual tubes. Each inner fin extends between two tube runs defined by opposite ends of a reverse bend. The inner fins have a length less than the overall length the column of tube runs.

The present invention represents a refinement in the development of the evaporator taught in U.S. Pat. Nos. 6,253,839 and 6,370,775.

DETAILED DESCRIPTION OF THE PREFERRED EMBODIMENTS

Figure 1:
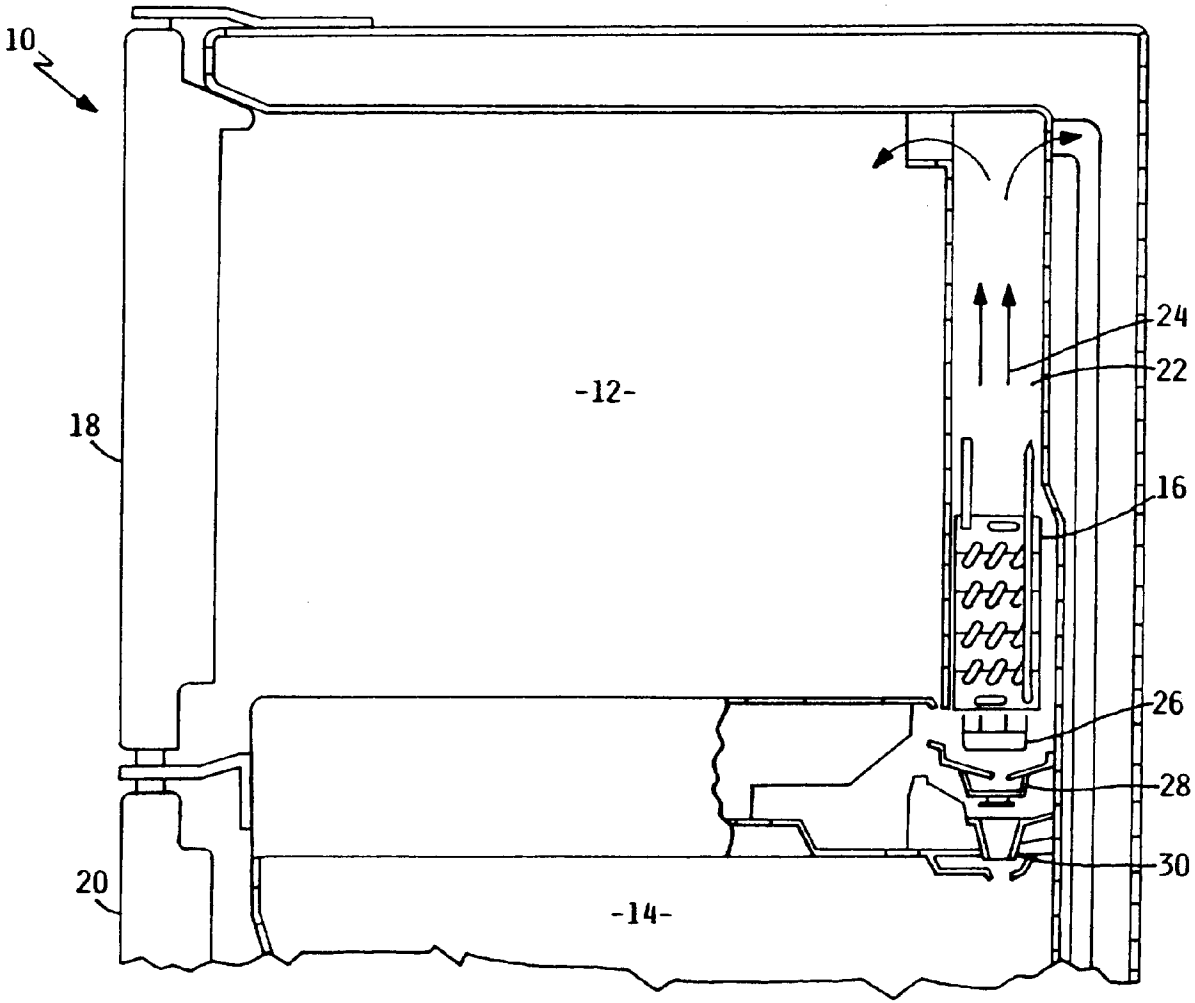
FIG. 1 (PRIOR ART)
FIG. 1 is a cross-sectional view of a refrigerator cabinet disposed within the freezer compartment including an evaporator.

Evaporators are used in a variety of environments to exchange heat between a first medium isolated from a second medium. FIG. 1 shows a typical refrigerator cabinet 10 having a freezer compartment 12 and a refrigeration compartment 14. Cold air for the freezer and refrigeration compartments 12 and 14 is provided by an evaporator 16. The freezer compartment 12 is sealed close by freezer door 18 having appropriate perimeter gaskets. The refrigeration compartment 14 is similarly sealed close by refrigeration door 20. An evaporator 16 is placed in a passageway 22 and is used to cool the air drawn in the direction indicated by the arrow 24, over the evaporator 16 and discharged into both the refrigeration and freezer compartments 12 and 14 by a fan (not shown).

The evaporator 16 is placed in a high humidity environment wherein cooling the air causes moisture to condense on the evaporator, resulting in the formation of frost and ice. As frost and ice gather on the evaporator 16, a heater element 26 is actuated to melt ice and frost from the evaporator 16. The resultant water is collected on a collecting pan 28 and removed through a drain 30 from the refrigerator.

Figures 2, 3:
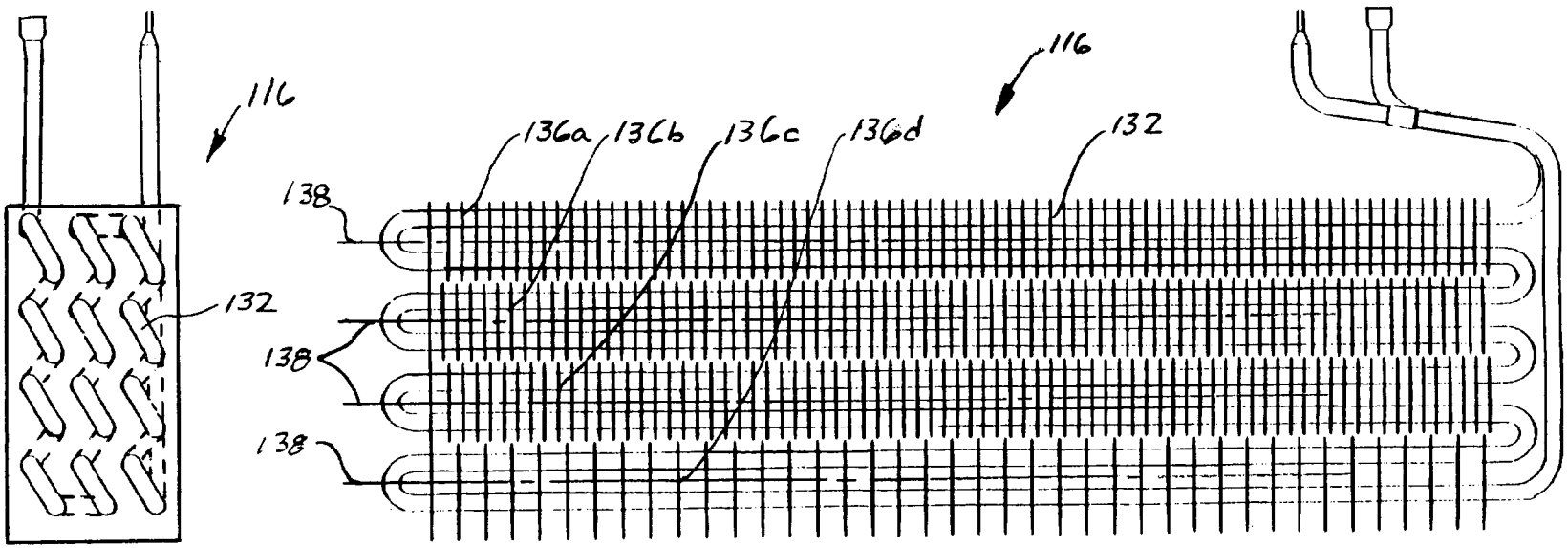
FIG. 3 (PRIOR ART)
FIG. 2 (PRIOR ART)
FIG. 2 is an end view of a prior art evaporator wherein each set of tube runs is approximately parallel to an adjacent set of tube runs.
FIG. 3 is a front view of the prior art evaporator of FIG. 2.

FIGS. 2 and 3 illustrate a prior art evaporator. The prior art evaporator 116 comprises a serpentine tube 132, four rows 136*a*,136*b*,136*c*,136*d* of inner fins 134 and a single outer fin 140 mounted on the serpentine tube 132. The centerline 138 of each row 136 of inner fins 134 is approximately parallel to the centerline of the adjacent row of inner fins.

Figure 5:
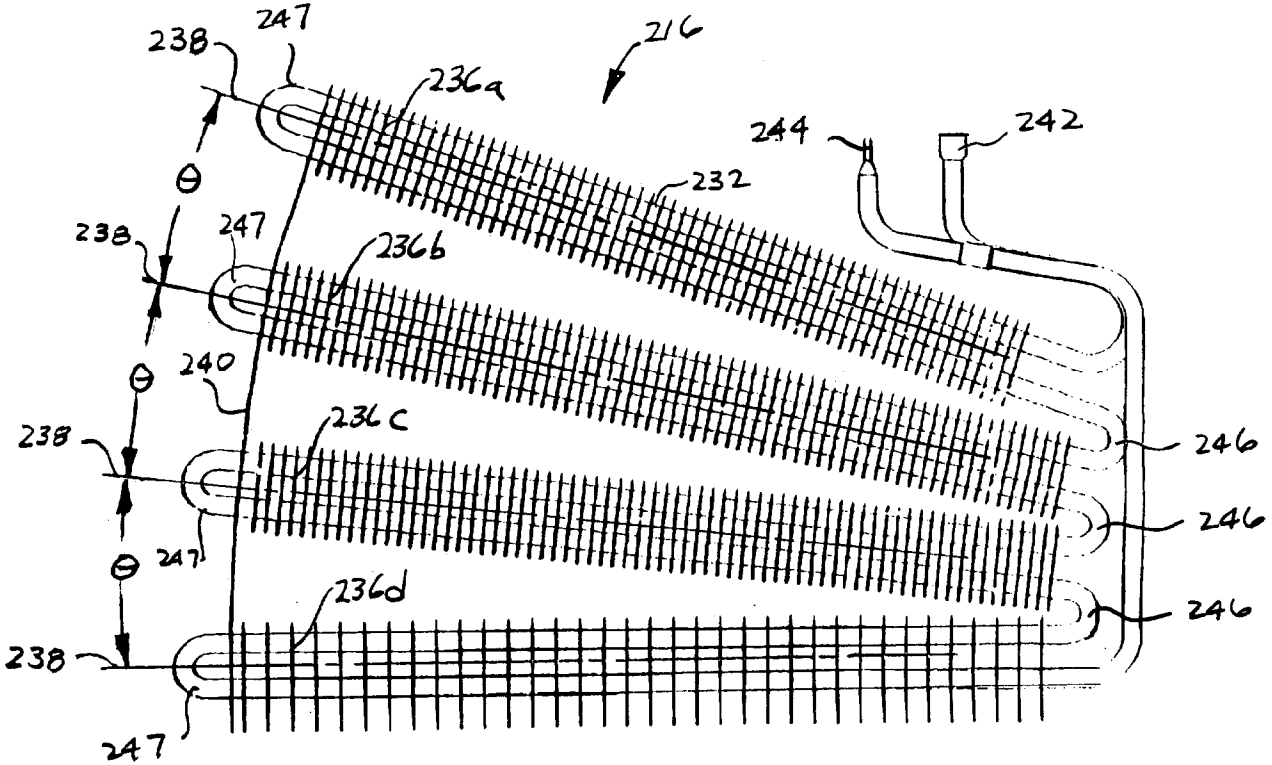
FIG. 5 is a front view of the evaporator of FIG. 4.
Figure 4:
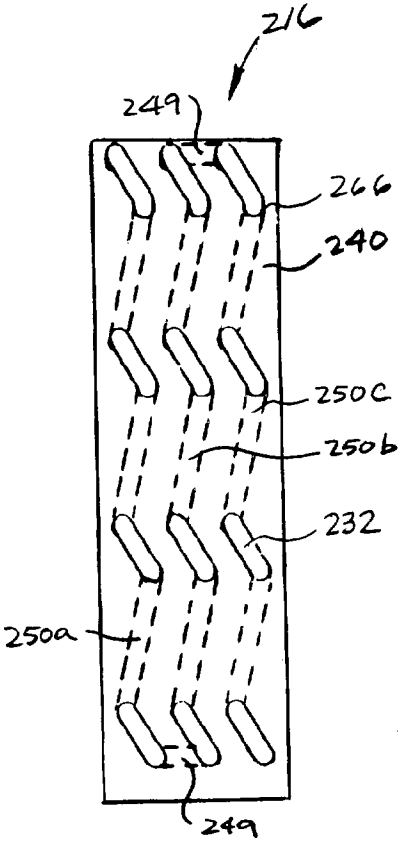
FIG. 4 is an end view of an evaporator in accordance to the present invention.

An evaporator 216, in accordance to the present invention, is illustrated in FIGS. 4 and 5. Similar to the prior art evaporator 116, the evaporator 216 comprises an aluminum serpentine tube 232, four rows 236*a*,236*b*,236*c*,236*d* of inner fins 234 and a single outer fin 240 mounted on the serpentine tube 232. The evaporator 216 is different from the prior art evaporator 116 in that the centerline 238 of each row 236 of inner fins 234 is not parallel to the centerline of an adjacent row of inner fins.

Figure 6:
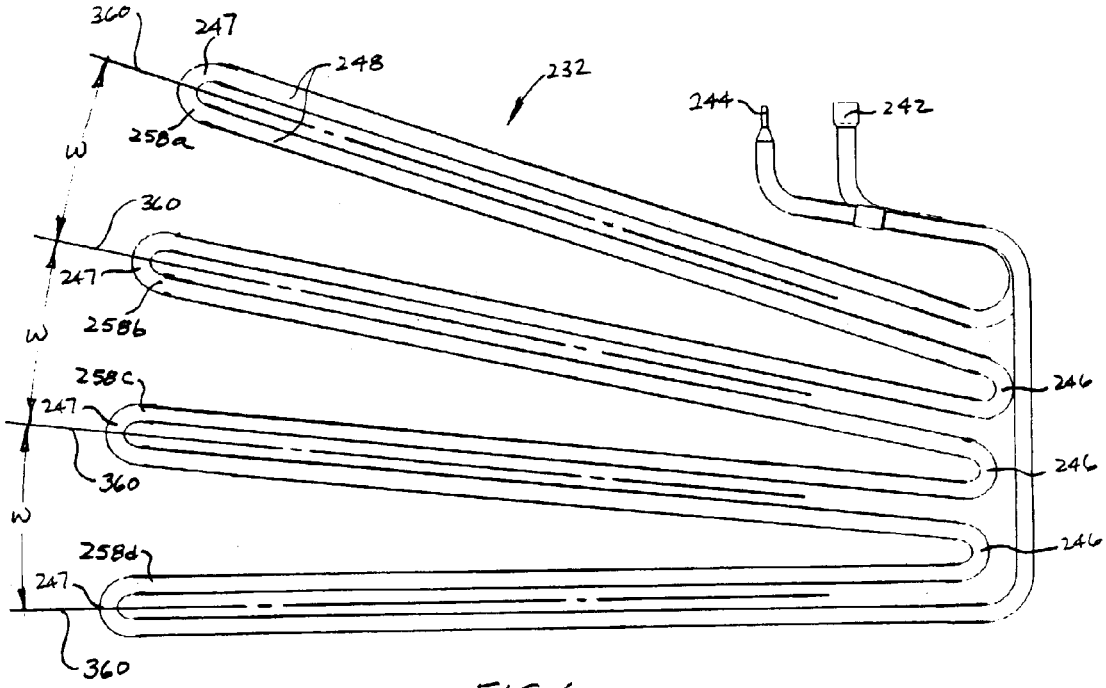
FIG. 6 is a front view of the tube bundle of FIG. 4.

Referring now to FIG. 6, the aluminum serpentine tube 232 is a continuous aluminum tube having an inlet 242 and an outlet 244. It should be noted that the term "continuous tube" does not require the tube to be formed from a single tube. Rather, the continuous tube can be several individual tubes joined by abutting the ends together to form a continuous tube. The continuous tube has a plurality of inner reverse bends 246 and outer reverse bends 247. Straight tube runs 248 are defined between corresponding inner reverse bends 246 and outer reverse bends. Each reverse bend 246, 247 of the serpentine tube bundle 232 staggers sequential tube runs 248, such that the next tube run 248 is not linearly inline with the previous tube run 248. This offset of the tube runs 248 increases the surface area of the tube runs which are disposed in the path of the air drawn in for cooling, thus increasing convection heat transfer.

The rows of staggered tube runs 248 continue for a number of rows to form a column 250 of tube runs. At the end of the first column 250*a* of tube runs, an end reverse bend 249 bends the tube to start a second column 250*b* of tube runs. The second column 250*b* of tube runs 248 is formed of rows of staggered tube runs 248, as in the first column 250*a*. The second column 250*b* extends generally back towards the start of the first column 250*a*. Each tube run 248 of the second column 250*b* is situated directly behind a corresponding tube run of the first column 250*a*. The spacing between each of the tube runs of the second column 250*b* and the corresponding tube run of the first column 250*a* (directly in front of the tube run of the second column 44) is approximately the same for each corresponding tube runs. Likewise, each reverse bend 246,247 of the second column 250*b* is situated directly behind and angled in a similar direction as a corresponding reverse bend 246,247 of the first column 250*a*. Similarly, a third column 250*c* of tube runs 248 is formed, wherein each tube run 248 and each reverse bend 246,247 of the third column 250*c* are situated directly behind corresponding tube runs and reverse bends of the second column 250*c*.

The tube runs 248 of each column are grouped into four sets 258*a*,258*b*,258*c*,288*d* of tube runs. Each tube run sets 258 includes an outer reverse bend 247 and the two tube runs extending from the ends of the outer reverse bend 247. It should be noted that while the present embodiment illustrates a tube run set as one outer reverse bend and the two tube run extending from the ends of the outer reverse bend; for the purpose of this invention, a tube run set is defined as a group of two or more tube runs for which a single inner fin is attached thereon. Therefore, an alternative embodiment for a tube run set may include two outer reverse bends and the four tube runs extending from the two outer reverse bends. As illustrated in FIG. 6, the centerline 260 of each tube run set 258 is not parallel to the centerline 260 of an adjacent tube run set 258. The angle ω between the centerlines 260 of the non-parallel tube run sets 258 is preferably greater than 2 degrees and more preferably greater than 6 degrees.

A row 236 of inner fins 234 are retained on and extends between the two tube runs of one tube run set 258. Each inner fin 234 has a length less than the overall length of each column 250 of tube runs. The inner fins 234 of each row 236 are approximately equally spaced. The inner fins 234 of each row 236 are offset from the inner fins of the adjacent row by approximately one-half of the spacing between the inner fins. This offset of the inner fins 234 provides a staggered arrangement in the direction of the air flow. The staggered arrangement of the inner fin 234 increases the area of the inner fins coming in contact with the air flow, thus increasing the convection heat transfer and the efficiency of the evaporator.

It is common knowledge in the industry that frost build up can be controlled by varying the spacing between the inner fins 234. Since inner fins in the bottom row 236*d* of inner fins come into contact with the moist air first, more frost tends to build up on the inner fins 234 of the bottom row 236*d* than the inner fins of the other rows 236*a*,236*b*,236*c*. For this reason, the spacing between the inner fins 234 of the bottom row 236*d* is greater than the spacing between the inner fins 234 of other rows 236*a*,236*b*,236*c*. This increased spacing between the inner fins of the bottom row 236*d* allows a greater amount of frost to be built up on the inner fins of the bottom row while still allowing sufficient spacing for the air to travel through the frost buildup. This increased space between the inner fins allows a greater time interval between the need to activate the heater element 226 to melt the frost build up on the evaporator.

Figure 7:
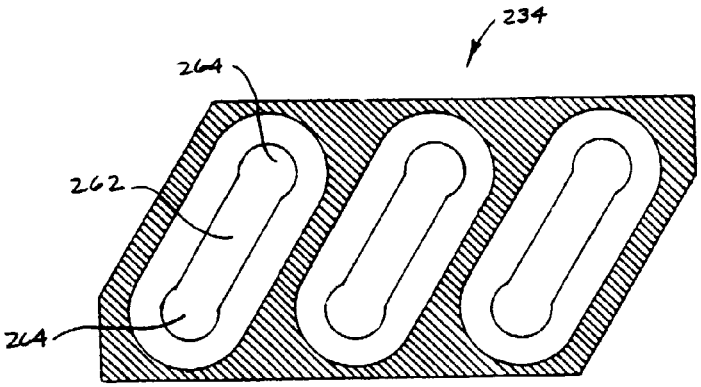
FIG. 7 is an end view showing in detail the inner fin of FIG. 4.

Each inner fin 234, illustrated in detail in FIG. 7, defines three equally spaced slots 262. The number of slots 262 and the location of the slots 262 correspond to the number of columns 250 of tube runs and the location of the outer reverse bends 247. An enlarged radius 264 is formed at both terminal ends of each slot 264. The distance between the locus of the enlarged radius 264 is approximately equal to the distance between the center of the tube runs of the opposite ends of an outer reverse bend 247.

Since each row 236 of inner fins are mounted on a corresponding tubing run set 258 not parallel to its adjacent tubing run set 258, the centerline 238 of each row 236 of inner fins likewise are not parallel to the centerline 238 of an adjacent row 236 of inner fins, as illustrated in FIG. 5. The angle θ between the centerlines 238 of the non-parallel rows of fins is preferably greater than 2 degrees and more preferably greater than 6 degrees.

The inner fins 234 may be installed onto the serpentine tube 232 after the tube run sets 253 are bent to the desired angle ω. By bending all the inner reverse bends 246 to the desired angle ω prior to installing the inner fins reduces, the chance of damaging the inner fins 234 is greatly reduced. Furthermore, without inner fins 234 installed onto the set 253 of tube runs, the process of bending of the inner reverse bend 246 to define the desired angle ω between two tube run sets can more easily accomplished.

Alternatively, the inner fins 234 can be installed onto the serpentine tube 232 with the tube run sets approximately parallel to the adjacent tube runs. The inner reverse bends 246, defining the angle ω between the tube run sets, are re-bent after the installation of the inner fins 234 onto the serpentine tube 232. While the re-bending the inner reverse bends 246 requires an step, depending on the fixture used for installing the inner fins 234 onto the tube run sets, installing the inner fins 234 onto parallel tube run sets may be considerable easier than installing inner fins onto non-parallel tube run sets. For instance, U.S. Pat. No. 6,253,839 to Reagen et al. discloses a fixture for installing inner fins onto parallel tube run sets. The fixture and the method for installing inner fins as disclosed in U.S. Pat. No. 6,253,839 Reagen et al. are incorporated herein by reference. By using the fixture and the method for installing inner fins as disclosed in Reagen et al., the inner fins 234 can be first installed onto the parallel tube run sets. Once the inner fins 234 are installed using the fixture and method disclosed in Reagen et al., the inner reverse bends 246 defining the angle between the tube run sets 258 can be re-bent to the desired angle ω.

With the inner fins 234 installed onto the tube run sets 258 and the inner reverse bends 246 bent to the desired angle ω, the outer fin 240 is installed onto the serpentine tube 232. The outer fin 240 has three columns and four rows of slots 266 defined in the outer fin 240. The number of slots 266 and the location of the slots correspond to the number of outer reverse bends 247 and the location of the outer reverse bends. The outer fins 240 increases the effect heat absorbing area and acts as a support at the end of the evaporator.

Figure 8:
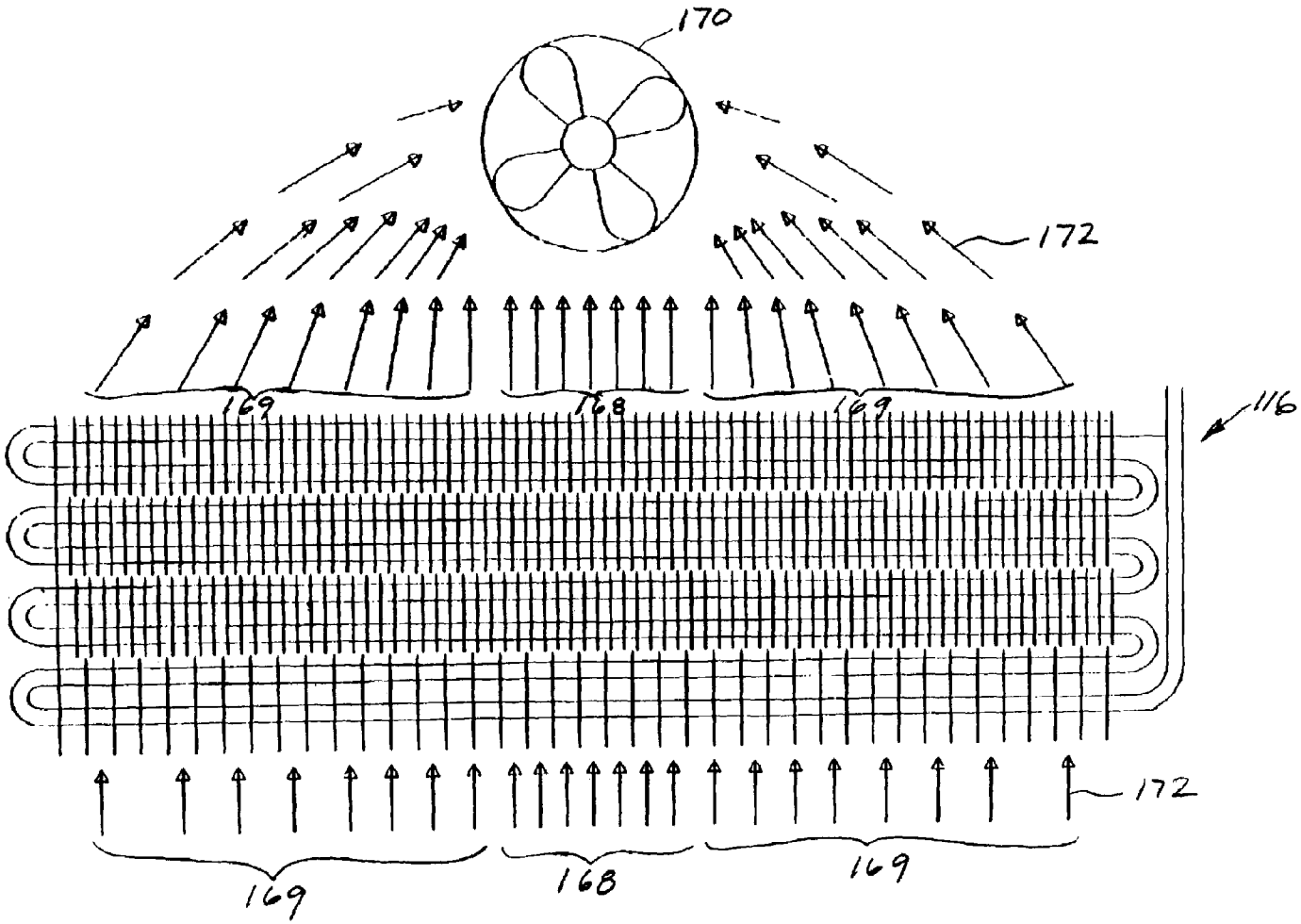
FIG. 8. (PRIOR ART)
FIG. 8 is a front view of the prior art evaporator of FIG. 2, showing the airflow distribution.
Figure 9:
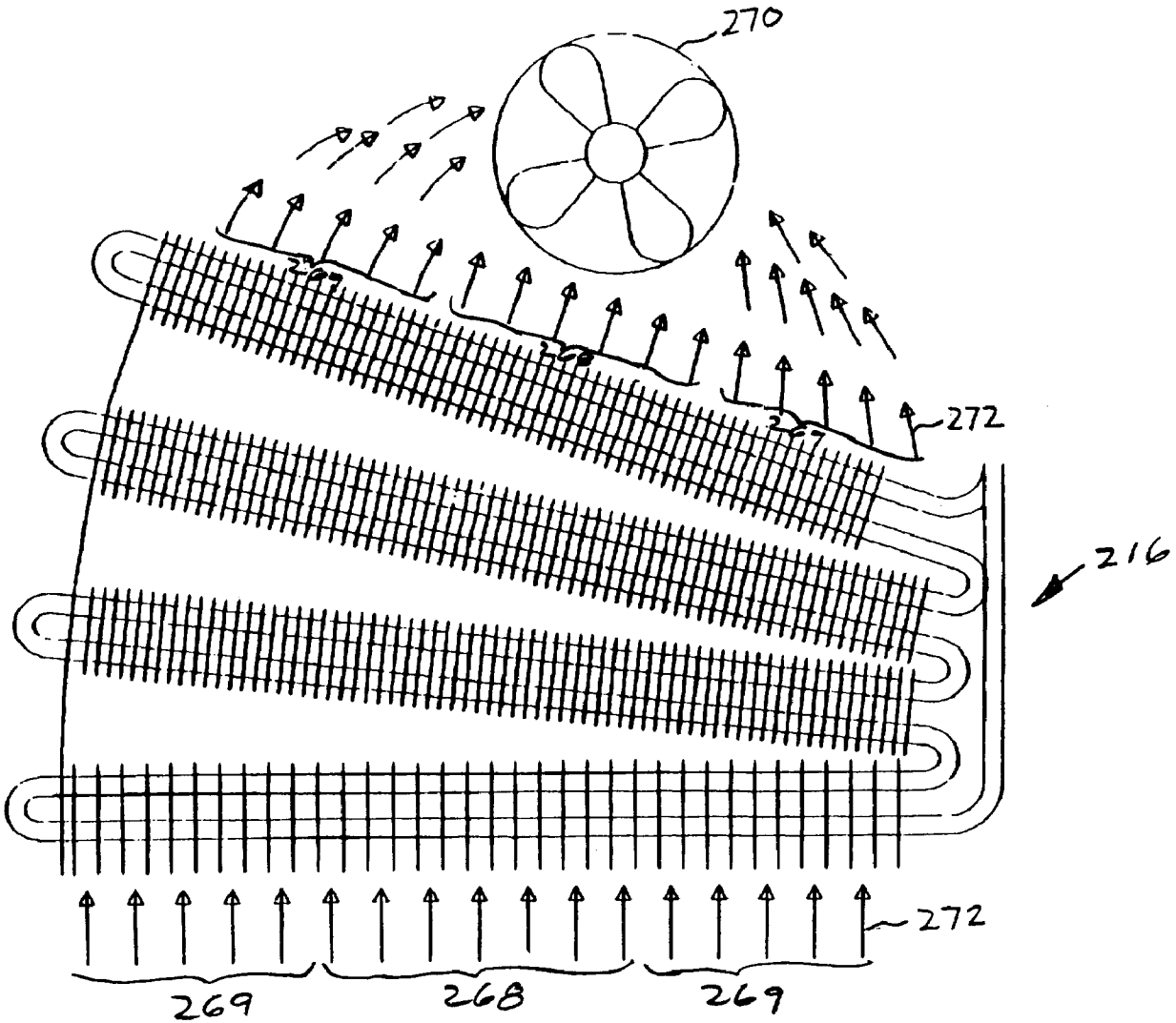
FIG. 9 is a front view of the evaporator of FIG. 4, showing the airflow distribution.

The advantages of the evaporator in accordance to the present invention are illustrated in FIGS. 8–11. FIG. 8 illustrates the air flow distribution of a prior art evaporator 116. In conjunction with the prior art evaporator 116, a fan 170 is located down stream of the air flow. The fan draws air 172 from the bottom of the evaporator 116, through the evaporator and towards the fan 170. Since the fan creates a focal point for the air flowing through the evaporator, more airflow occurs through the center horizontal section 168 of the evaporator and less airflow occurs through the side horizontal sections 169 of the evaporator 116. This uneven airflow through the evaporator 116 prevents the evaporator from operating efficiently.

Figure 10:
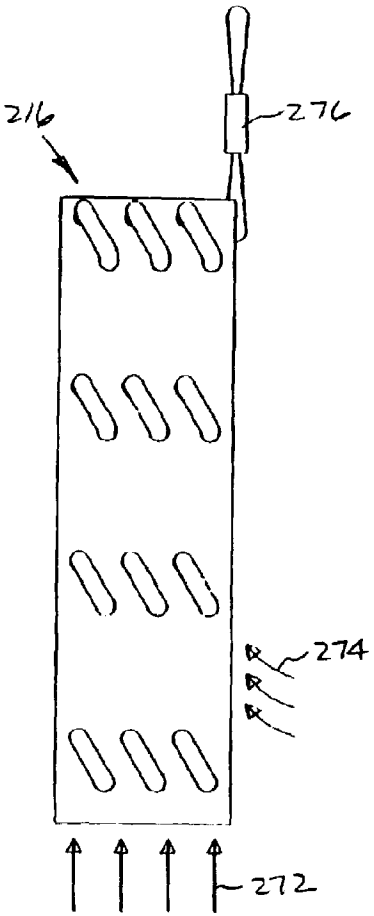
FIG. 10 is an end view of the evaporator of FIG. 4, showing the moist fresh food air flow and dryer freezer air flow.

FIG. 10 illustrates the air flow distribution of the evaporator 216 in accordance to the present invention. Similar to the set up for the prior art evaporator 116, a fan 270, located down stream of the air flow, is used in conjunction with the evaporator to draw air 272 through the evaporator 216. As the air 272 enters the evaporator, the air is redirected, from a straight-ahead flow, by the next rows of inner fins. Since the inner fins 234 of each row 236 are not parallel with the inner fins 234 of the adjacent down stream row 236, the air 272 exits the evaporator 216 with a rotational component. This rotational component causes the airflow at the side horizontal sections 269 of the evaporator to flow more quickly to the fan 270 than airflow without a rotational component; thus, allowing the air flowing through the side sections 269 of evaporator to be approximately equal to the air flowing through the center section 268 of the evaporator. Therefore, an evaporator with non-parallel tube run sets is able to distribute airflow more evenly than an evaporator with parallel tube run sets. This more even airflow distribution allows the evaporator 216, in accordance to the present invention, to operate more efficiently. In addition to reducing the energy consumption of a refrigerator through the use of the evaporator in accordance to the present inventor, a more efficient evaporator also allows for smaller packing space required for the evaporator. Furthermore, by providing a much larger gap between the rows of inner fins on one side of the evaporator, the possible of frost gathering between the rows of inner fins is greatly reduced. This improves the evaporator's capability to collect frost.

Figure 11:
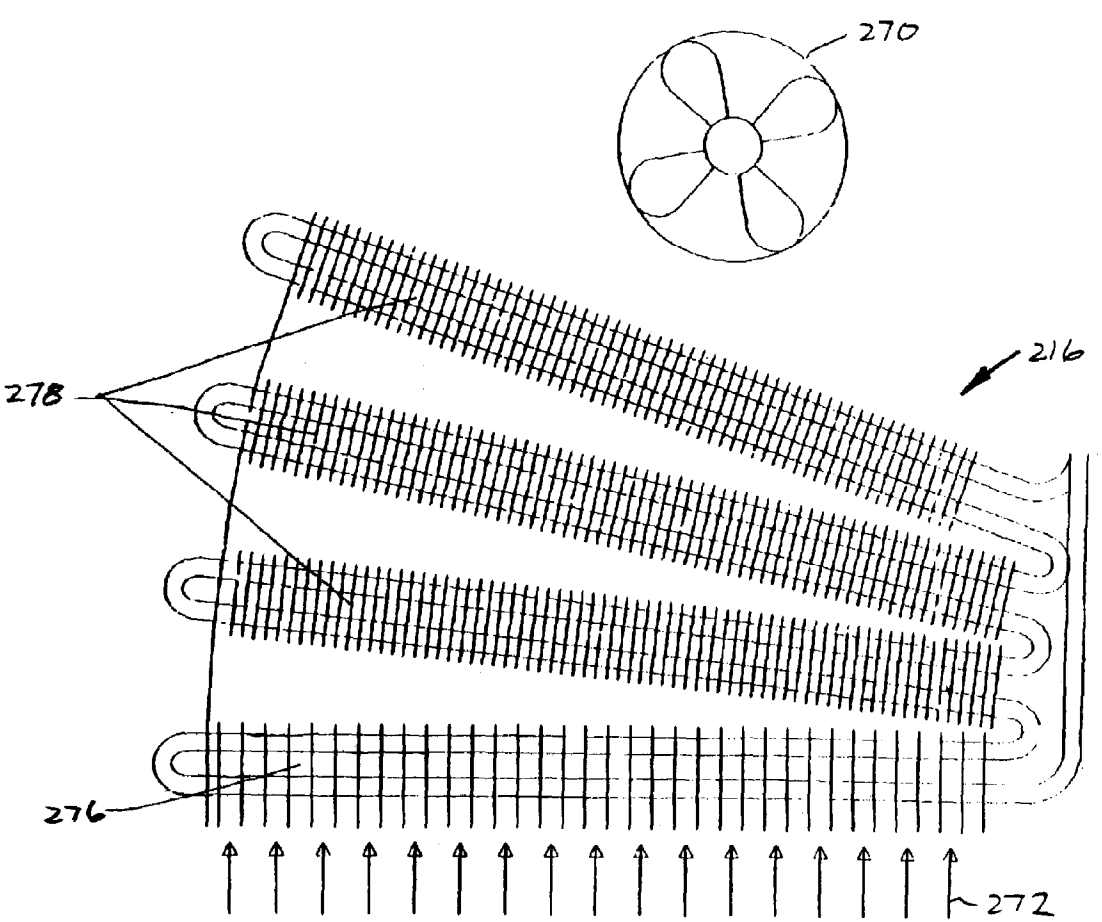
FIG. 11 is a front view of the evaporator of FIG. 4, showing the moist fresh food air flow.

To allow the lower portion 276 (e.g. the bottom row of inner fins having larger spacing between the inner fins) of the evaporator 216 to be dedicated to collecting frost resulting from the moisture in the fresh food air 272 entering the evaporator 216, the dryer freezer air 274 can be routed from the side of the evaporator 216 to bypass the lower portion 276 of the evaporator 216. As illustrated in FIGS. 10 and 11, the moist fresh food 272 air enters the evaporator 216 from the bottom of the evaporator 216. By entering the evaporator 216 from the bottom, the frost resulting the moisture in the air is able to be collected at the lower portion 276 of the evaporator 216. The dryer freezer air 274 is drawn into the evaporator 216 from the side of the evaporator, above the lower portion 276 of the evaporator 216. By bypassing the lower portion 276 of the evaporator, which has less fins and possible frost build-up, the freezer air is able to only flow through the high efficiency portions 278 of the evaporator 216. Such routing the freezer air 274 to bypass the lower portion 276 of the evaporator 216 improves the efficiency of the evaporator 216.

Figure 13:
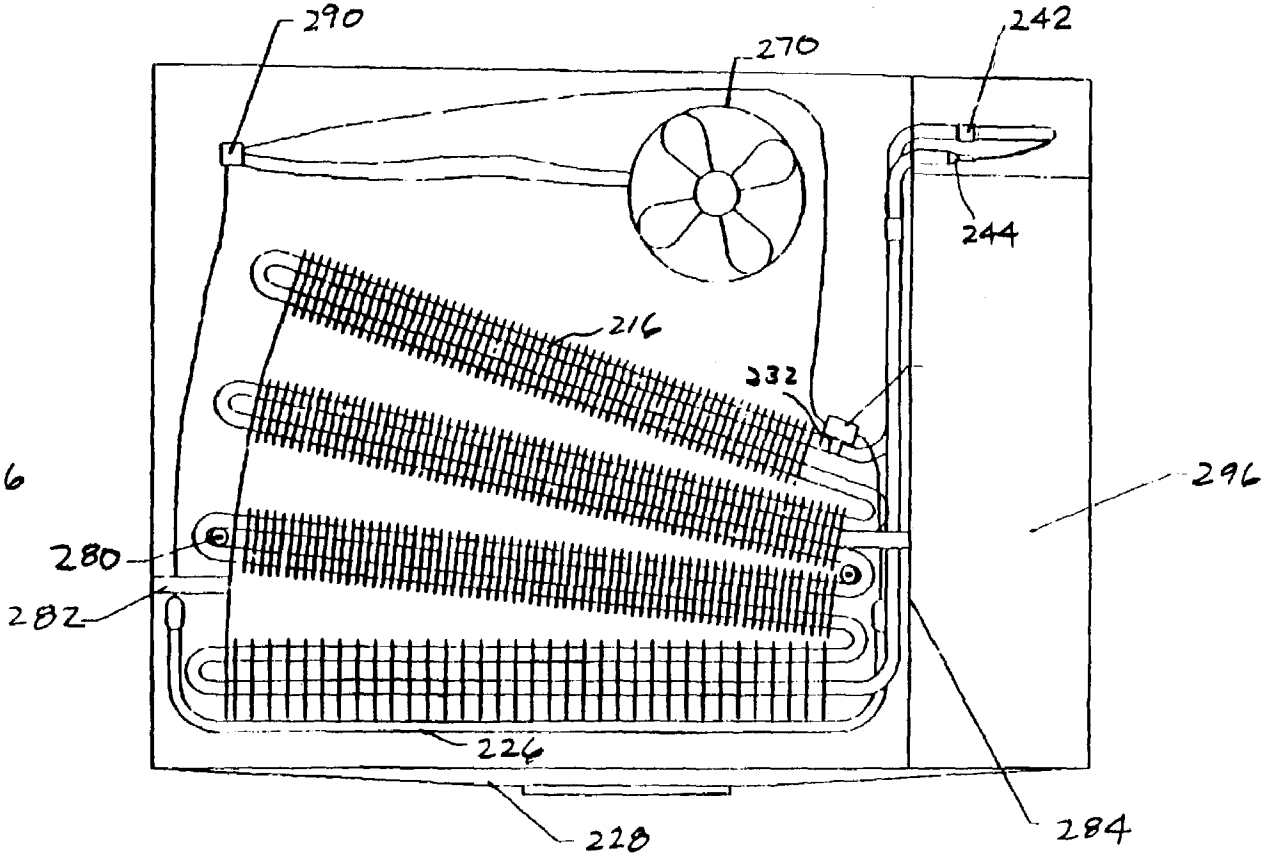
FIG. 13 is a front of the evaporator of FIG. 4 as installed in a refrigeration applicance.
Figure 12:
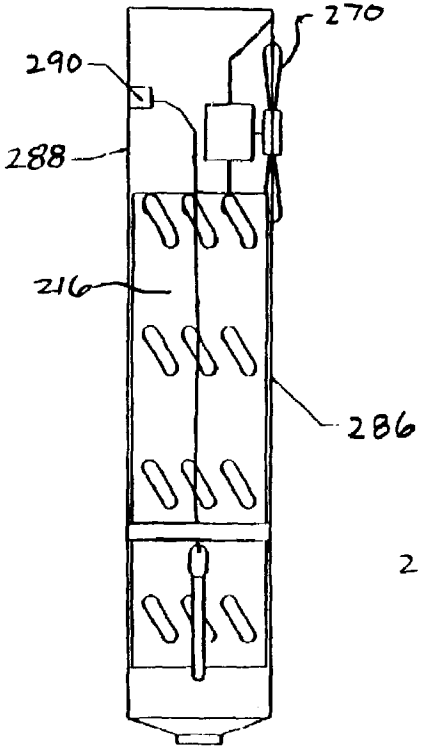
FIG. 12 is an view of the evaporator of FIG. 4 as installed in a refrigeration appliance.

FIGS. 12 and 13 illustrated the basic installation of the evaporator 216 to a refrigeration appliance, in conjunction with its associated components. The Evaporator 216 is attached to a refrigeration appliance 210 by the means of a plurality of mounting pegs 280 retaining the evaporator 216 to the refrigeration appliance 210. Air blocks 282 are fitted between the evaporator 216 and the coil covers 284 to prevent the air from flowing around the sides of evaporator 216; thus, the air blocks 282 assure the air flows through the evaporator 216. An evaporator cover 286 and a plastic liner 288 further close the front and rear of the evaporator 216 to assure that the air flows through the evaporator. A plug 290, mounted to the plastic liner 288, provides the power to operate a defroster heater 226 located underneath the evaporator 216. A drain trough 228, located beneath the evaporator 216 and the defroster heater 226, collects the water resulting from the defroster heater 226 melting the frost accumulated on the evaporator 216. The plug 290 also provides the power to operate the fan 270 attached to the evaporator cover 286. A thermostat 294 is attached to the serpentine tube 232 to measure the temperature of the evaporator 216. The inlet 242 of the serpentine tube and the outlet 244 of the serpentine tube is brazed to the refrigerant system. As evident from FIG. 13, due to the improved efficiency of the evaporator 216, in accordance to the present invention, extra food storage space 296 is created.

A second aspect of the evaporator, in accordance to the present invention, is illustrated in FIGS. 13–17. As previously discussed, the inner fins and the outer fins are installed onto the aluminum serpentine tube by inserting the outer return bends of the serpentine tube through the slots of the inner fins and the slots of the outer fins. The inner fins and the outer fin are typically retained onto the corresponding tubing runs by means of an interference fit between the enlarge radius of the fins with the corresponding tubing runs. While this interference fit between the fins with the tubing runs is generally sufficient to retain the fins onto the serpentine tube, occasionally due to manufacturing tolerances, the radius of the enlarge radius of a fin may be larger than the outer radius of the corresponding tubing run. When this situation arises, an interference fit is not created to retain that portion of the fin to the serpentine tubing. Furthermore, without the serpentine tube contacting the fin, conductive heat transfer does not occur between the serpentine tube and the fin. The second aspect of the present invention addresses this problem by assuring that the fin allows contacts the serpentine tube.

Figure 14:
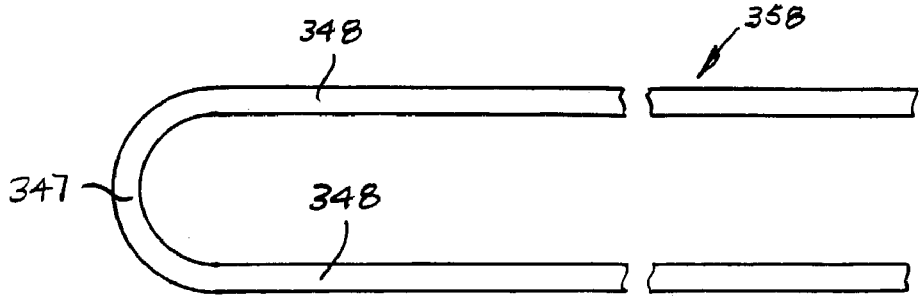
FIG. 14 is a front view of a tube run set in accordance to a second aspect of the present invention.
Figure 15:
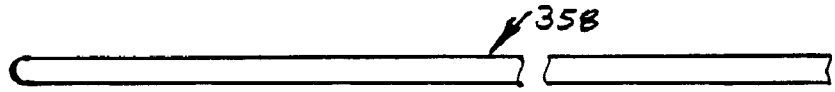
FIG. 15 is a side view of the tube run set of FIG. 14.
Figure 16:
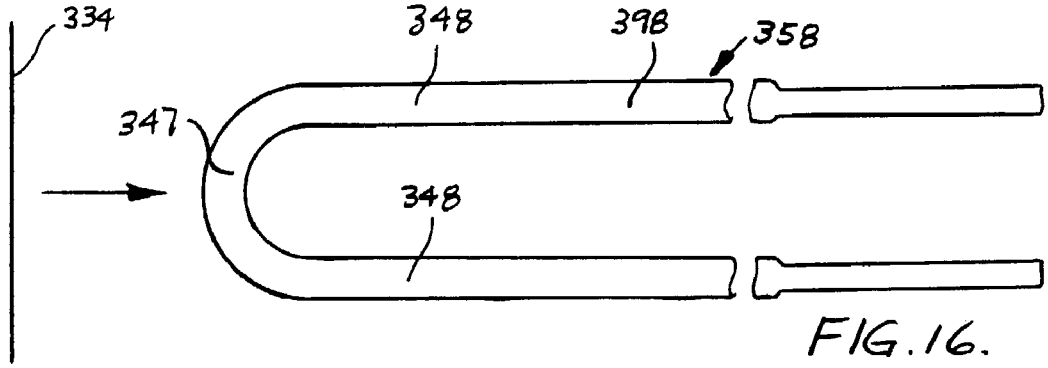
FIG. 16 is a front view of the tube run set of FIG. 14 after the outer return bend and a portion of the tube runs were flattened.
Figure 17:
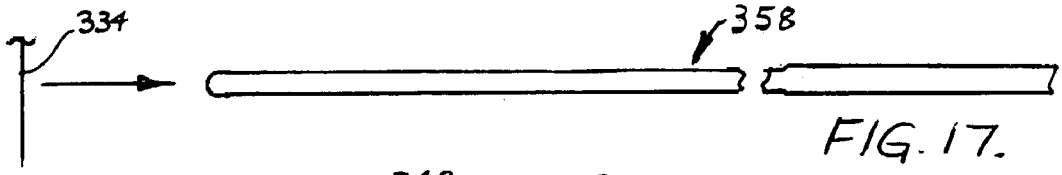
FIG. 17 is a side view of the tube run set of FIG. 15.
Figure 18:
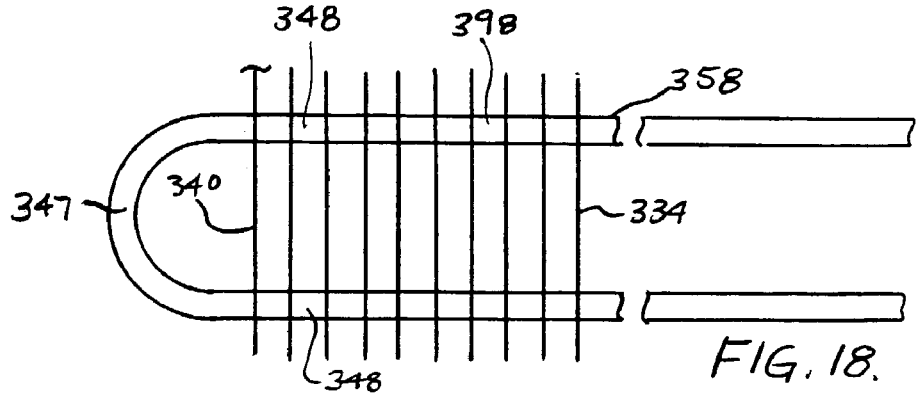
FIG. 18 is a front view of the tube run set of FIG. 16 after a plurality of fins were installed on the flattened tubes runs and after the flattened portions of the serpentine tube were expanded under high pressure air.
Figure 19:
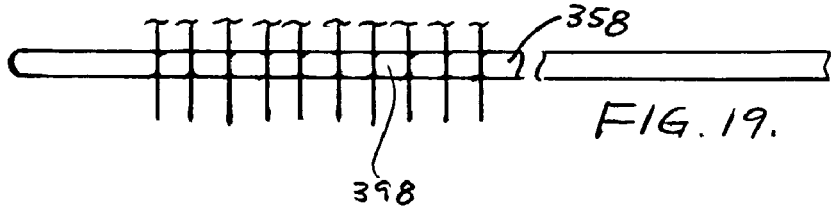
FIG. 19 is a side view of the tube run set of FIG. 18.

FIGS. 13 and 14 illustrate a set 358 of tube runs of an evaporator. The tube run set 358 is flatten from the return bend 346 to a given distance from the outer return bend 347, as illustrated in FIGS. 15 and 16. The given distance for the flattened portion 398 of the tube run set 358 should extend to at least the point for which the inner fins 334 would be positioned over the tube runs 348. The tube run set 358 is flattened such that the thickness of the flattened portion 398 is slight smaller than the enlarged radius of the slot of the inner fins 334 and the slot of the outer fin 240. After the inner fins 334 and the outer fin 340 have been properly positioned over the flattened portion 398, high pressure air is applied to the aluminum serpentine tube 332 to expand the flattened portions 398 until the outer diameter of the flattened potions contacts the enlarged radius of the fins 334,340. Since the tube run set 358 is inserted through the slots defined in the inner fins 334 and the outer fin 340 after the tube run set 358 have been flattened, the pre-flattened diameter of the serpentine tube can be significantly larger than the enlarged radius of the slot defined in the inner fins 334 and the outer fin 340. This relative dimension between the enlarged radius of the slot defined in the fins 334,340 and the outer diameter of the serpentine tube assures a tight fit between the fins and the serpentine tube after the flattened portion has been expanded.

In addition to creating to tighter fit between the serpentine tube and the fins 334,340 by expanding the flattened portion 398 of the tube run set 358; by reforming the flattened portion 398, including the outer return bend 347, to an approximate circular shape, the pressure drop of the refrigerant flowing the serpentine tubing is greatly reduced as compared to leaving the tube run set 358 flattened. This reduction in pressure drop of the refrigerant flow reduces the power the compressor needs to pump refrigerant through the system.

Various features of the present invention have been described with reference to the preferred embodiments. It should be understood that modifications may be made to the preferred embodiments without departing from the spirit and scope of the present invention as represented by the following claims.

The invention claimed is:

1. An evaporator for disposition along an air flow for cooling the air comprising:

a continuous serpentine tube having an inlet and an outlet, said serpentine tube including at least one column of tube runs, said tube runs grouped into tube run sets, each tube run set defined by at least one reverse bend and the tube runs extending from the ends of said at least one reverse bend, each of said tube run sets defines a centerline, the centerline of one of said tube run set is not parallel to the centerline of an adjacent tube run set;

a plurality of inner fins attached to said serpentine tube, each said inner fin extending between at least two tube runs of a tube run set.

2. The evaporator as claimed in claim 1 wherein the angle between the centerline of said one of said tube run set is at an angle of at least two degrees from the centerline of an adjacent tube run set.

3. The evaporator as claimed in claim 1 wherein the angle between the centerline of said one of said tube run set is at an angle of at least six degrees from the centerline of an adjacent tube run set.

4. The evaporator as claimed in claim 1 wherein the tube runs of a tube run set are approximately parallel.

5. An evaporator for disposition along an air flow for cooling the air comprising:

a continuous serpentine tube having an inlet and an outlet, said serpentine tube including at least one column of tube runs;

at least two rows of inner fins attached to said serpentine tube, each said inner fin extending between at least two tube runs; each of said rows of inner fins defines a centerline, the centerline of one of said row of inner fins is not parallel to the centerline of an adjacent row of inner fins.

6. The evaporator as claimed in claim 5 wherein the centerline of said one of said row of inner fins is at an angle of at least two degrees from the centerline of an adjacent row of inner fins.

7. The evaporator as claimed in claim 5 wherein the centerline of said one of said row of inner fins is at an angle of at least six degrees from the centerline of an adjacent row of inner runs.

8. A method of forming an evaporator comprising the steps of:

providing a continuous tube;

bending said tube into a serpentine tube pattern to include a plurality of inner reverse bends, a plurality of outer reverse bends and a plurality of parallel tube runs extending between said inner reverse bends and said outer reverse bends;

providing a plurality of inner fins, each of said inner fin having a slot to receive one of said outer reverse bend;

inserting one of said outer reverse bends of said serpentine tube through said slot in said plurality of inner fins; and bending said inner reverse bend such that one of said tube runs defined at one end of said inner reverse bend is not parallel to another of said tub runs defined at the other end of said inner reverse bend.

9. The method as claimed in claim 8 wherein said one of said tube run defined at one end of said inner reverse bend is bent at an angle at least 2 degrees from said another of said tube run defined at the other end of said inner reverse bend.

10. The method as claimed in claim 8 wherein said one of said tube run defined at one end of said inner reverse bend is bent at an angle at least 6 degrees from said another of said tube run defined at the other end of said inner reverse bend.

11. An evaporator for disposition along an air flow for cooling the air comprising:

a continuous serpentine tube having an inlet and an outlet, said serpentine tube including at least one column of a plurality of tube runs, said tube runs grouped into tube run sets, each tube run set includes two tube runs defined by the ends of a reserve bend, each of said tube run sets defines a centerline, wherein the centerline of one of said tube run set is at an angle relative to the centerline of an adjacent tube run set;

a plurality of inner fins attached to said serpentine tube, each said inner fin extending between said two tube runs of a tube run set.

12. The evaporator as claimed in claim 11 wherein the angle between the centerline of said one of said tube run set is at an angle of at least two degrees from the centerline of an adjacent tube run set.

13. The evaporator as claimed in claim 11 wherein the angle between the centerline of said one of said tube run set is at an angle of at least six degrees from the centerline of an adjacent tube run set.

14. The evaporator as claimed in claim 11 wherein the tube runs of a tube run set are approximately parallel.

* * * * *